US005721510A

United States Patent [19]

Miyajima

[11] Patent Number: 5,721,510

[45] Date of Patent: Feb. 24, 1998

[54] SEMICONDUCTOR INTEGRATED CIRCUIT HAVING A SUBSTRATE BACK BIAS VOLTAGE GENERATING CIRCUIT WHICH IS RESPONSIVE TO A POWER SUPPLY DETECTION CIRCUIT

[75] Inventor: Yasushi Miyajima, Tokyo, Japan

[73] Assignee: NEC Corporation, Tokyo, Japan

[21] Appl. No.: 616,579

[22] Filed: Mar. 15, 1996

[30] Foreign Application Priority Data

Mar. 15, 1995 [JP] Japan ..... 7-055465

[51] Int. Cl.[6] ..... G05F 1/10

[52] U.S. Cl. ..... 327/536; 327/537; 327/538; 327/534

[58] Field of Search ..... 327/536, 537, 327/538, 540, 589, 544, 332, 534

[56] References Cited

FOREIGN PATENT DOCUMENTS 63-4491 1/1988 Japan .

*Primary Examiner*—Timothy P. Callahan
*Assistant Examiner*—Jung Ho Kim
*Attorney, Agent, or Firm*—Sughrue, Mion, Zinn, Macpeak & Seas, PLLC

[57] ABSTRACT

In a semiconductor integrated circuit including a substrate back bias voltage generating circuit composed of a substrate back bias voltage generating circuit, and a power supply voltage detecting circuit for comparing a reference voltage with a power supply voltage and for generating a power supply voltage detecting signal which is brought to the first level when the power supply voltage is higher than the reference voltage, and to a second level when the power supply voltage is not higher than the reference voltage. A substrate leak control circuit generates a leak control pulse when the power supply voltage detecting signal changes from the first level to the second level. A substrate leak circuit responds to the leak control pulse so as to connect the substrate to a predetermined potential through a resistive means having a predetermined resistance value.

4 Claims, 4 Drawing Sheets

SUBSTRATE
Vbb
Q61
I6
Q62
R61
3 VOLTAGE GENERATING CIRCUIT
Q32
Q31
C31
IV31
SUBSTRATE LEAK CIRCUIT 6
LEC
C51
Q51
IV53
IV52
LAO
53 LEAK CONTROL PULSE GENERATOR
52 LATCH CIRCUIT
G54
G53
51 ONE-SHOT PULSE GENERATOR
2 OSCILLATING CIRCUIT
G23
G22
G21
IV21
Pons
G52
D51
IV51
5 SUBSTRATE LEAK CONTROL CIRCUIT
G51
Dbmp
CBRB
Dvsu
1 SUBSTRATE VOLTAGE DETECTING CIRCUIT
4 VOLTAGE SUPPLY BUMP DETECTING CIRCUIT
Q14
Q15
Q16
Q11
Q12
Q13
VCC
IV41
Q47
Q48
Q46
Q45
Q42
Q43
Q44
Q44

SEMICONDUCTOR INTEGRATED CIRCUIT HAVING A SUBSTRATE BACK BIAS VOLTAGE GENERATING CIRCUIT WHICH IS RESPONSIVE TO A POWER SUPPLY DETECTION CIRCUIT

BACKGROUND OF THE INVENTION

1. Field of the Invention

The present invention relates to a semiconductor integrated circuit, and more specifically a semiconductor integrated circuit having a substrate back bias voltage generating circuit for supplying a predetermined bias voltage to a substrate in which an electronic circuit including field effect transistors is formed.

2. Description of Related Art

In a semiconductor integrated circuit such as a semiconductor memory composed of field effect transistors, it is in many cases that, for the purpose of reducing a parasitic capacitance between a substrate in which an electronic circuit including field effect transistors is formed, and respective circuit constituting elements in the electronic circuit, there is provided a substrate back bias voltage generating circuit for supplying a predetermined bias voltage to the substrate.

Referring to FIG. 1, there is shown a circuit diagram of a typical conventional substrate back bias voltage generating circuit provided in the semiconductor integrated circuit, which is called a "first prior art" hereinafter.

The substrate back bias voltage generating circuit of the first prior art includes a substrate voltage detecting circuit 1*x* configured to compare a reference voltage with a substrate back bias voltage $V_{bb}$ supplied to the substrate and to generate a substrate voltage detection signal Dvsu, which is brought to a first level when the absolute value of the substrate back bias voltage $V_{bb}$ (which is a negative voltage in ordinary eases) is larger than the absolute value of the reference voltage, and to a second level when the absolute value of the substrate back bias voltage $V_{bb}$ is smaller than the absolute value of the reference voltage.

The shown circuit of the first prior art also includes a first oscillating circuit 2*x* which is brought into an oscillating condition in response to the second level of the substrate voltage detection signal Dvsu, for an active level period of a timing signal $\phi$ras Corresponding to a memory address selecting operation period. In the other period, this first oscillating circuit 2*x* which is brought into an oscillation stop condition. An output of the first oscillating circuit 2*x* is connected to a first voltage generating circuit 3*x*, which includes inverters $IV_{31}$ and $IV_{32}$, a capacitor $C_{32}$, and transistors $Q_{33}$ and $Q_{34}$, which are connected as shown. The first voltage generating circuit 3*x* generates a first substrate back bias voltage $V_{bb}$ having a predetermined level, and supplies the first substrate back bias voltage $V_{bb1}$ the substrate (not shown) with a predetermined current supply capacity.

The shown circuit of the first prior art also includes a second oscillating circuit 2*y* supplied with a power supply voltage $V_{CC}$ and ceaselessly maintained in an oscillating condition, and a second voltage generating circuit 3*y*, which receives an output of the second oscillating circuit 2*y* and which includes inverters $IV_{33}$ and $IV_{34}$, a capacitor $C_{33}$, and transistors $Q_{35}$ and $Q_{36}$, which are connected as shown. This second voltage generating circuit 3*y* generates a second substrate back bias voltage $V_{bb2}$ having a predetermined level, and supplies the second substrate back bias voltage $V_{bb2}$ the substrate (not shown) with a current supply capacity smaller than that of the first voltage generating circuit 3*x*.

In this example of the first prior art, during the memory address selecting operation period, the substrate back bias voltages $V_{bb1}$ and $V_{bb2}$ are supplied from the first voltage generating circuit 3*x* having a relative large current supplying capacity and the second voltage generating circuit 3*y* having a relative small current supply capacity, thereby maintaining the substrate potential at a predetermined voltage during this period so as to stabilize an operation. During the other period, namely, during the memory address non-selecting operation period (standby period), it is sufficient if only a leak from the substrate is compensated. Therefore, the substrate back bias voltage $V_{bb2}$ is supplied from only the second voltage generating circuit 3*y* having the relative small current supply capacity. As a result, an overall consumed electric power of the substrate back bias voltage generating circuit is reduced.

However, since a very large parasitic capacitance exists between the substrate and the power supply voltage VCC or a ground potential, even if a fluctuation of the power supply voltage VCC is in a rated range, the absolute value of the substrate back bias voltage $V_{bb}$ is caused to relatively change by the fluctuation of the power supply voltage. For example, when the absolute value of the substrate back bias voltage $V_{bb}$ becomes low (namely, small) because the power supply voltage VCC has become high, the substrate voltage detecting circuit 1*x*, the oscillating circuit 2*x* and the first voltage generating circuit 3*x* operate to compensate for However, when the absolute value of the substrate back bias voltage $V_{bb}$ becomes high (namely, deep) because the power supply voltage $V_{CC}$ has become low, the compensating operation does not act. In addition, because of the substrate bias effect, a threshold of transistors becomes large, so that an operation speed of the circuit becomes late or slow, with the result that an undesired condition continues for a long time.

In order to prevent the above inconvenience, a so called supply voltage bump countermeasure has been proposed to form a leak path between the substrate and the power supply voltage or the ground potential. In this method, however, since a leak current ceaselessly flows through the leak path, the substrate back bias voltage $V_{bb2}$ supplied from the second voltage generating circuit 3*y* drops, so that the substrate back bias voltage $V_{bb}$ changes when the memory address selecting operation period is switched to the memory address non-selecting operation period and vice versa. As a result, a stable operation of each electronic circuit cannot be obtained.

Under the above mentioned circumstance, Japanese Patent Application Laid-open Publication No. JP-A-63-004491, the disclosure of which is incorporated by reference in its entirety into the present application, has proposed a semiconductor integrated circuit having a substrate back bias voltage generating circuit configured to prevent fluctuation of the substrate back bias voltage $V_{bb}$ when the memory address selecting operation period is switched to the memory address non-selecting operation period and vice versa.

Referring to FIG. 2, there is shown a circuit diagram of a conventional substrate back bias voltage generating circuit proposed by JP-A-63-004491, which is called a "second prior art" hereinafter.

The shown circuit of the second prior art includes a substrate voltage detecting circuit 1*x*, an oscillating circuit 2X and a voltage generating circuit 3X, for the purpose of supplying a first substrate back bias voltage $V_{bb1}$ with a relative large current supply capability during a memory address selecting operation period. The shown circuit of the second prior art also includes another oscillating circuit 2Y receiving the power supply voltage Vcc and ceaselessly maintained in an oscillating condition, a delay circuit 7 for delaying an output of the oscillating circuit 2Y by a predetermined time, and a second voltage generating circuit 3Y receiving the output of the oscillating circuit 2Y and the delayed output from the delay circuit 7, for supplying a second substrate back bias voltage $V_{bb21}$ comparable to the first substrate back bias voltage $V_{bb1}$, with a current supply capability which is smaller than that of the voltage generating circuit 3X. The second voltage generating circuit 3Y is composed of a NAND gate $G_{31}$, an inverter $IV_{36}$, a capacitor $C_{35}$ and transistors $Q_{3c}$ and $Q_{3d}$, which are connected as shown.

The shown circuit of the second prior art further includes a third voltage generating circuit 3Y receiving the output of the oscillating circuit 2Y and the delayed output from the delay circuit 7, for supplying a third substrate back bias voltage $V_{bb22}$ having an absolute value larger than that of the first substrate back bias voltage $V_{bb1}$, with a current supply capability which is smaller than that of the voltage generating circuit 3X. The third voltage generating circuit 3Z is composed of a NOR gate $G_{32}$, a capacitor $C_{36}$ and transistors $Q_{3e}$ and $Q_{3f}$, which are connected as shown.

During the memory address non-selecting operation period, the second and third voltage generating circuits 3Y and 3Z supply a leak current, and in addition, while supplying the leak current, a substrate back bias voltage $V_{bb20}$ having the same level as that of the first substrate back bias voltage $V_{bb1}$ is supplied, so that the substrate back bias voltage $V_{bb}$ does not fluctuate when the memory address selecting operation period is switched to the memory address non-selecting operation period or vice versa.

However, the substrate back bias voltage generating circuit of the second prior art is large in the consumed electric power, since the leak current always flows through the leak path.

The above mentioned substrate back bias voltage generating circuits are constructed to maintain the substrate back bias voltage at a constant level, regardless of the fluctuation of the power supply voltage within the rated range. Therefore, in a data retention operation in a dynamic RAM in which a power supply voltage is greatly dropped so as to perform a stored data holding operation, the substrate back bias voltage becomes too deep, with the result that a threshold of transistors is increased, a circuit operation margin is lowered, and therefore, a stable circuit operation cannot be obtained.

SUMMARY OF THE INVENTION

Accordingly, it is an object of the present invention to provide a semiconductor integrated circuit which has overcome the above mentioned defects of the conventional ones.

Another object of the present invention is to provide a semiconductor integrated circuit having a substrate back bias voltage generating circuit, which has a minimized consumed electric power and can speed up the operation when a power supply bump operates and when the operation is switched between the memory address selecting operation period and the memory address non-selecting operation period.

Still another object of the present invention is to provide a semiconductor integrated circuit having a substrate back bias voltage generating circuit, which can maintain a substrate back bias voltage suitable to an actual power supply voltage even if the actual power supply voltage greatly fluctuates, whereby a stable circuit operation can be ensured.

The above and other objects of the present invention are achieved in accordance with the present invention by a semiconductor integrated circuit including a substrate back bias voltage generating circuit comprising:

a substrate back bias voltage generating means including a substrate voltage detecting circuit for comparing a first reference voltage with a substrate back bias voltage supplied to a substrate, for generating a substrate voltage detecting signal indicative of a result of the comparison, an oscillating circuit brought to either the oscillating condition or the oscillation stop condition in response to the substrate voltage detecting signal, and a voltage generating circuit responding to an output of the oscillating circuit to generate the substrate back bias voltage of a predetermined level;

a power supply voltage detecting circuit for comparing a second reference voltage with a power supply voltage and for generating a power supply voltage detecting signal which is brought to a first level or a second level in accordance with a result of the comparison;

a substrate leak control circuit generating a leak control pulse having a predetermined pulse width when the power supply voltage detecting signal changes from the first level to the second level; and a substrate leak circuit responding to the leak control pulse for connecting the substrate to a predetermined potential through a resistive means having a predetermined resistance value.

The above and other objects, features and advantages of the present invention will be apparent from the following description of preferred embodiments of the invention with reference to the accompanying drawings.

DESCRIPTION OF THE PREFERRED EMBODIMENTS

Figure 1:
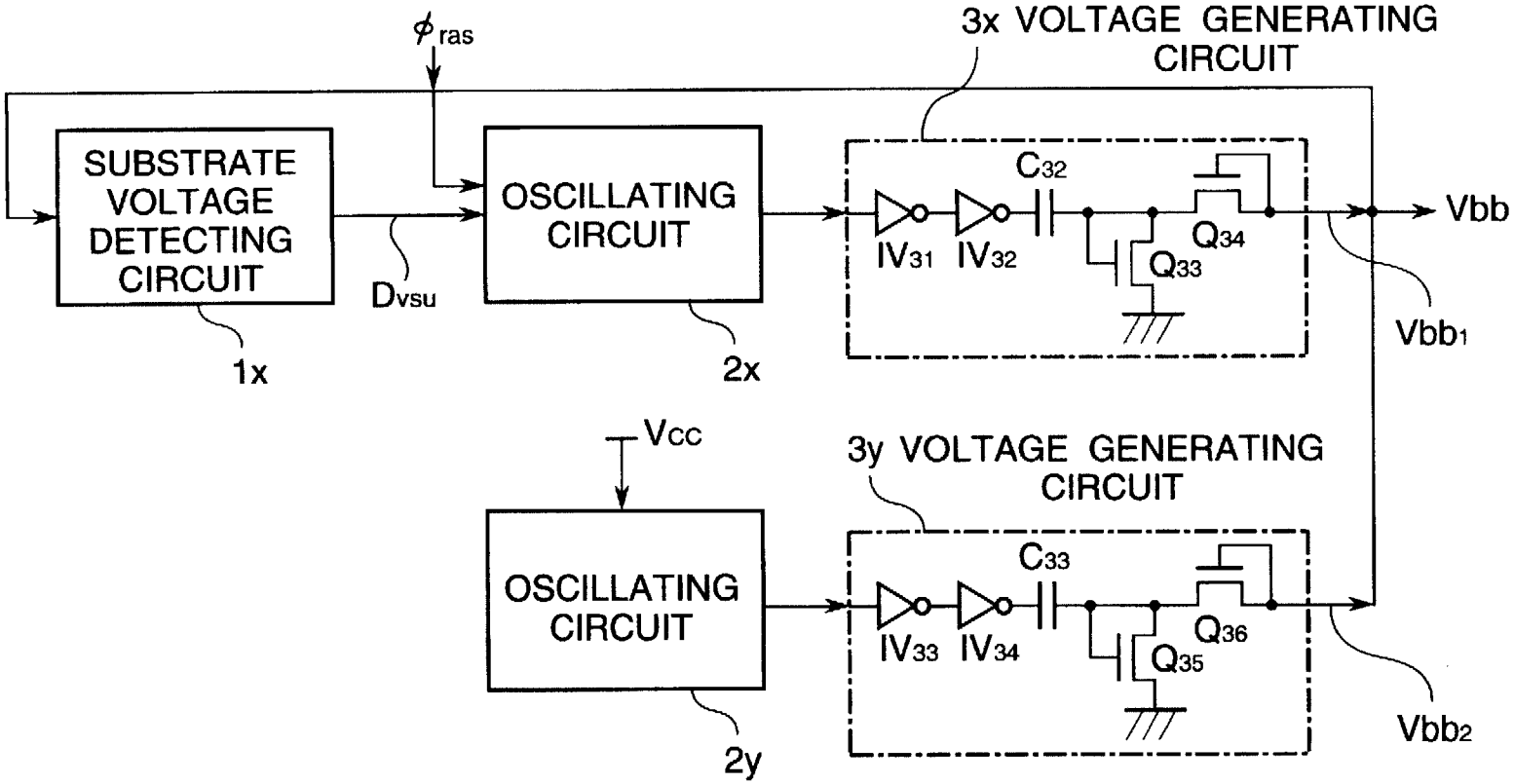
FIGURE 1 PRIOR ART
FIG. 1 is a circuit diagram of a typical substrate back bias voltage generating circuit of the first prior art, provided in the semiconductor integrated circuit.
Figure 2:
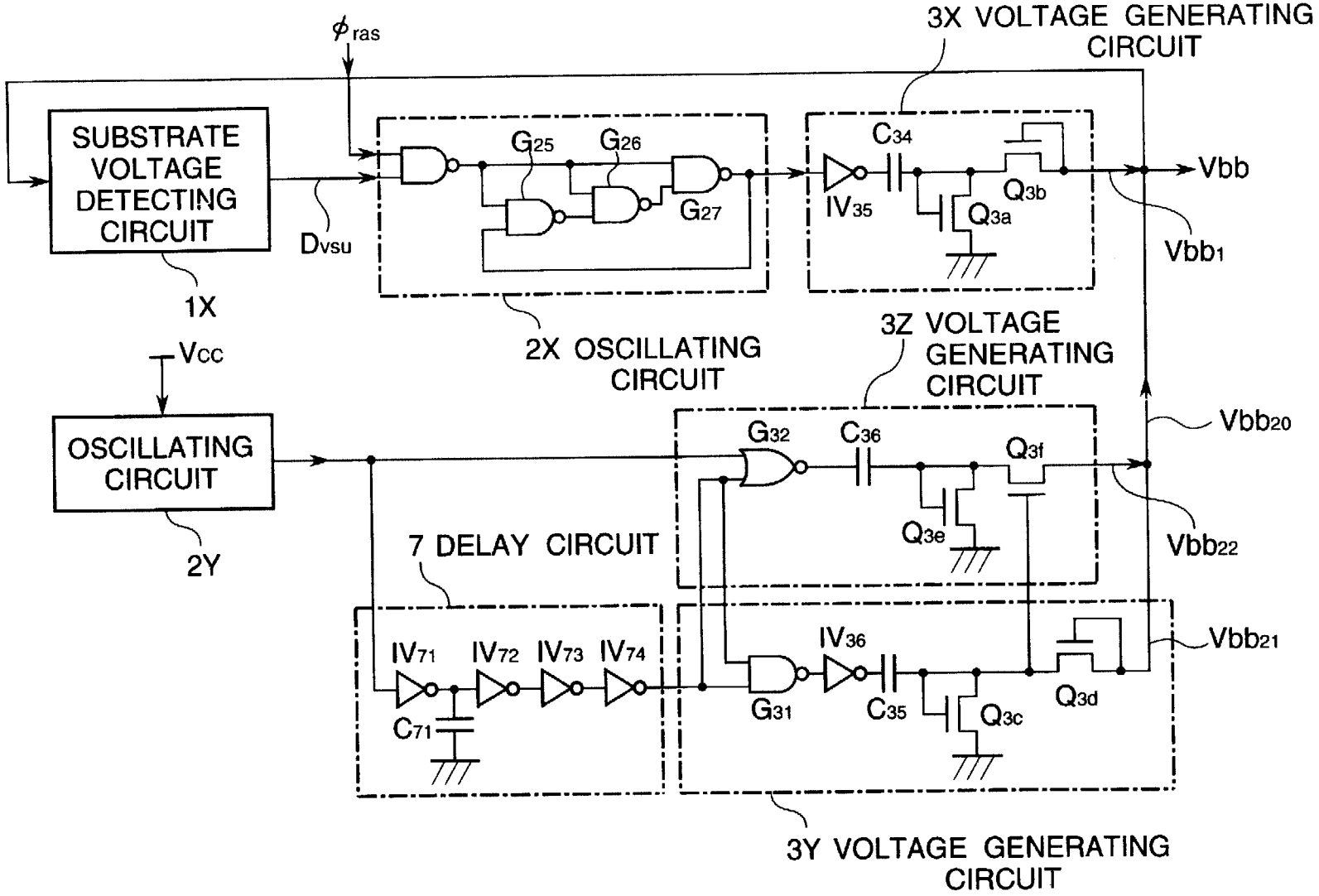
FIGURE 2 PRIOR ART
FIG. 2 is a circuit diagram of a substrate back bias voltage generating circuit of the second prior art, provided in the semiconductor integrated circuit.
Figure 3:
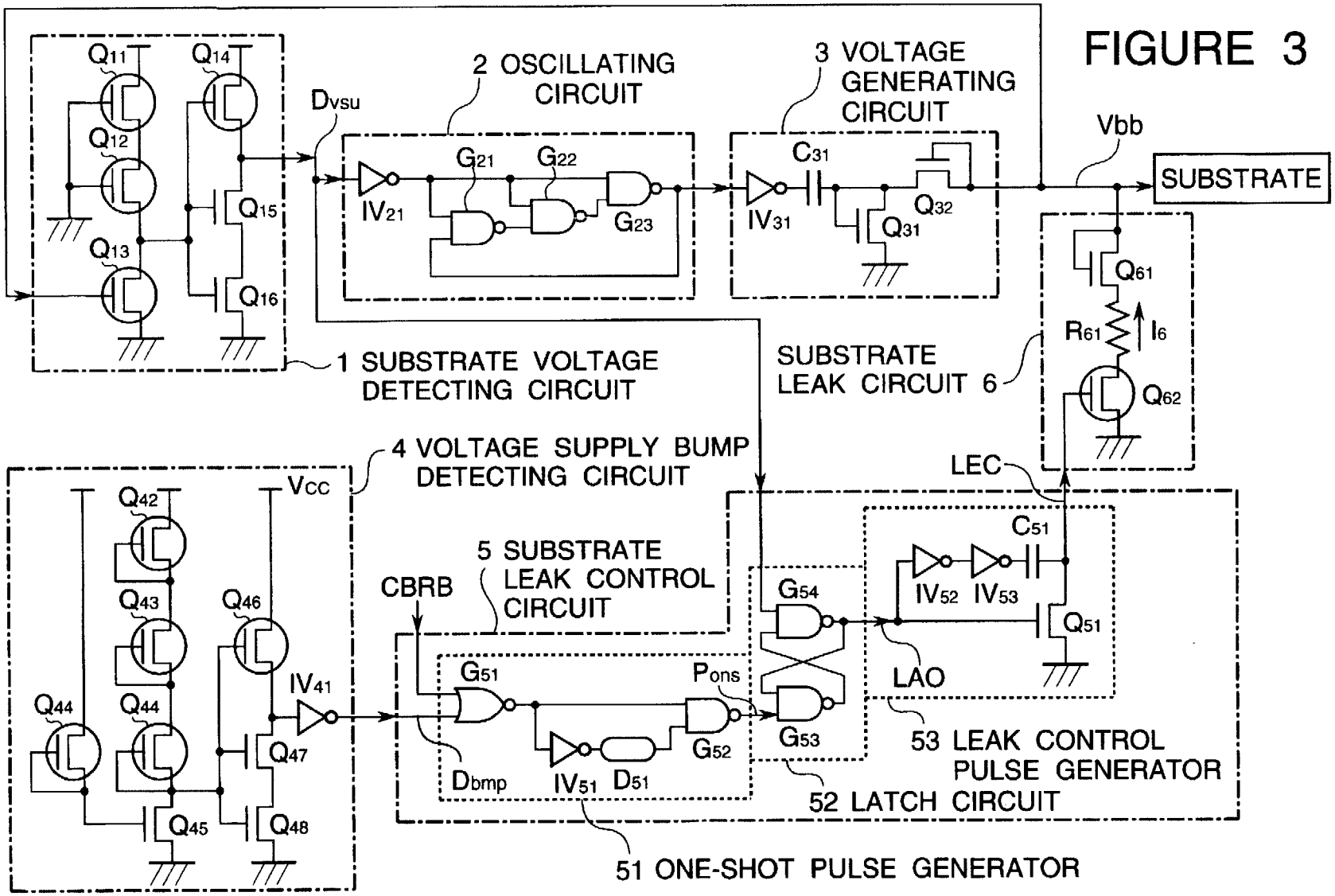
FIG. 3 is a circuit diagram of an embodiment of the substrate back bias voltage generating circuit in accordance with the present invention, provided in the semiconductor integrated circuit.

Referring to FIG. 3, there is shown a circuit diagram of an embodiment of the substrate back bias voltage generating circuit in accordance with the present invention, provided in the semiconductor integrated circuit.

The shown embodiment includes a substrate voltage detecting circuit 1 composed of transistors $Q_{11}$ to $Q_{16}$ connected as shown, for comparing a substrate back bias voltage $V_{bb}$ with a first reference voltage determined by the transistors $Q_{11}$ to $Q_{16}$. This substrate voltage detecting circuit 1 generates a substrate voltage detection signal Dvsu, which is brought to a first (logic) level when the absolute value of the substrate back bias voltage $V_{bb}$ (which is a negative voltage in ordinary cases) is larger than the absolute value of the first reference voltage, and to a second (logic) level (different from the first level, for example, complementary to the first logic level) when the absolute value of the substrate back bias voltage $V_{bb}$ is not larger than the absolute value of the first reference voltage.

The substrate voltage detection signal Dvsu is supplied to an oscillating circuit 2 composed of an inverter $IV_{21}$ and NAND gates $G_{21}$, $G_{22}$ and $G_{23}$, connected as shown. This oscillating circuit 2 is brought into an oscillating condition in response to the second level of the substrate voltage detection signal Dvsu, and into a non-oscillating condition (namely, oscillation stop condition) in response to the first level of the substrate voltage detection signal Dvsu.

An output of the oscillating circuit 2 is supplied to a voltage supply circuit 3 composed of an inverter $IV_{31}$, a capacitor $C_{31}$ and transistors $Q_{31}$ and $Q_{32}$, connected as shown. This voltage supply circuit 3 generates a substrate back bias voltage $V_{bb}$ of a predetermined level, and supplies the substrate back bias voltage $V_{bb}$ to a substrate (not shown) with a predetermined current supply capability.

The shown embodiment also includes a voltage supply bump detecting circuit 4 composed of transistors $Q_{41}$ to $Q_{48}$ and an inverter $IV_{41}$, connected as shown. This voltage supply bump detecting circuit 4 compares a power supply voltage $V_{CC}$ with a second reference voltage determined by the transistors $Q_{41}$ to $Q_{48}$ and the inverter $IV_{41}$, and generates a power supply voltage detection signal Dbmp, which is brought to a first (logic) level when the power supply voltage $V_{CC}$ is higher than the second reference voltage and to a second (logic) level (different from the first level, for example, complementary to the first logic level) when the power supply voltage $V_{CC}$ is not higher than the second reference voltage.

This power supply voltage detection signal Dbmp is supplied to a substrate leak control circuit 5 composed of a one-shot pulse generator 51, a latch circuit 52 and a leak control pulse generator 53. The one-shot pulse generator 51 is composed of a NOR gate $G_{51}$, an inverter $IV_{51}$, a delay element $D_{51}$, and a NAND gate $G_{52}$, connected as shown. The one-shot pulse generator 51 receive the power supply voltage detection signal Dbmp and generates a one-shot pulse Pons having a predetermined pulse width in response to a transition from the first level to the second level of the power supply voltage detection signal Dbmp, during an active period of a self-refresh entry signal CBRB (low active signal) in a data retention operation of a dynamic RAM.

The latch circuit 52 is composed of NAND gates $G_{53}$ and $G_{54}$ connected as shown, and outputs an output signal LAO, which is brought to a first (logic) level in response to the one-shot pulse Pons and to a second (logic) level (different from the first level, for example, complementary to the first logic level) in response to the second level of the substrate voltage detection signal Dvsu.

The output signal LAO is supplied to the leak control pulse generator 53, which is composed of inverters $IV_{52}$ and $IV_{53}$, a capacitor $C_{51}$ and a transistor $Q_{51}$. The leak control pulse generator 53 generates a leak control pulse LEC having a pulse width corresponding to the first level of the output signal LAO.

The leak control pulse LEC is supplied to a substrate leak circuit 6, which is composed of a transistor $Q_{61}$ connected in the form of a diode, a resistor $R_{61}$ and another transistor $Q_{62}$, which are connected in series between the substrate and the ground potential. The substrate leak circuit 6 responds to the leak control pulse LEC so as to connect the substrate to the ground through a predetermined resistance.

In the above mentioned embodiment, a substrate back bias voltage generating means is constituted of the substrate voltage detecting circuit 1, the oscillating circuit 2 and the voltage generating circuit 3.

Figure 4:
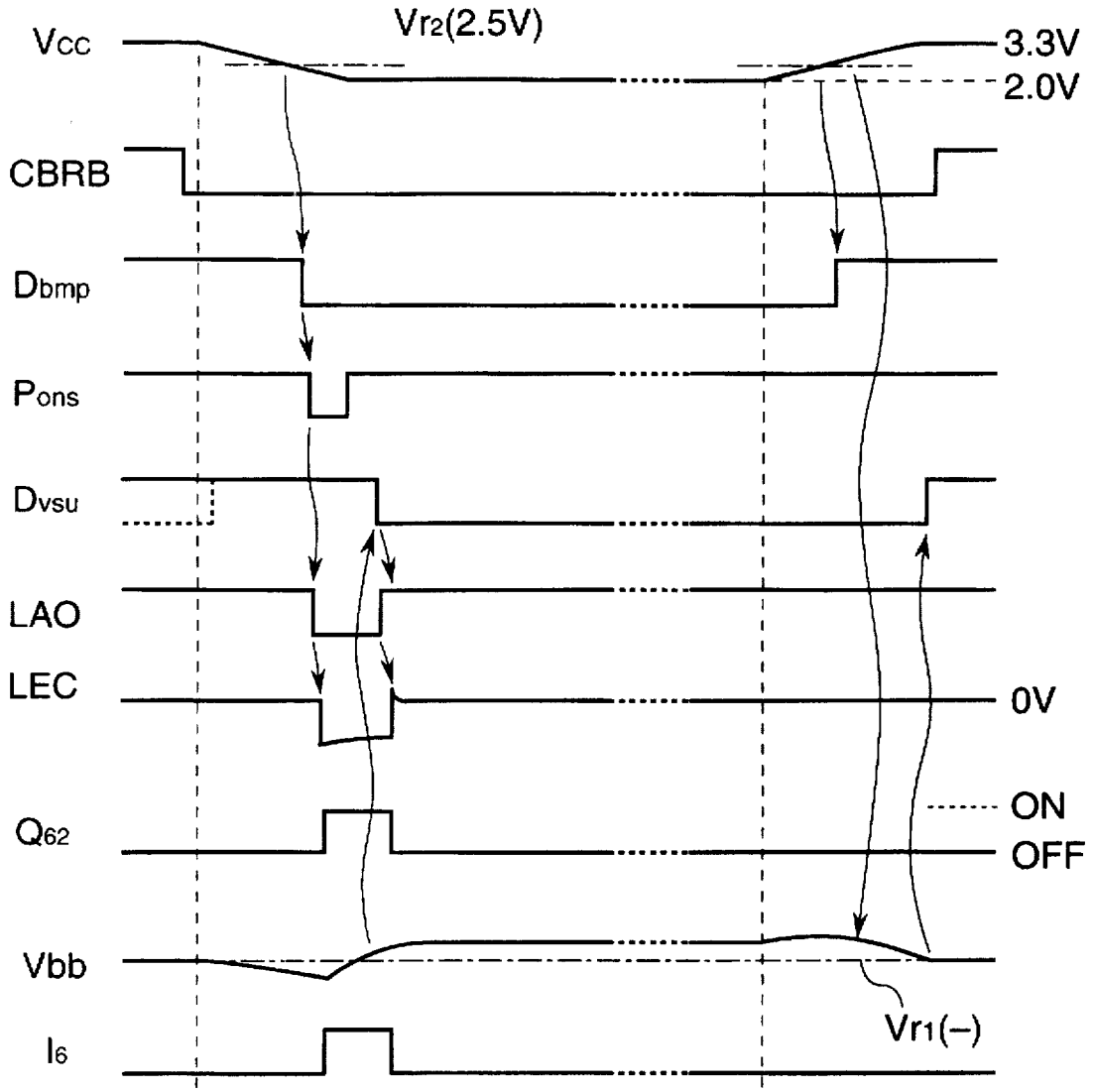
FIG. 4 is a timing chart illustrating an operation of the substrate back bias voltage generating circuit shown in FIG. 3.

Now, operation of the shown embodiment will be described with reference to FIG. 4, which is a timing chart illustrating an operation of the substrate back bias voltage generating circuit shown in FIG. 3. As shown in FIG. 4, the power supply voltage $V_{CC}$ is 3.3 V in an ordinary operation and 2.0 V in a data retention operation.

In the ordinary operation having the power supply voltage $V_{CC}$ of 3.3 V, the power supply voltage detection signal Dbmp from the power supply bump detecting circuit 4 is at the first level, namely at a high level, and the self retention entry signal VBRB is also at a high level, so that the substrate leak control circuit 5 is inactive. Therefore, the substrate back bias voltage $V_{bb}$ having a predetermined level is supplied to the substrate, by action of the substrate voltage detecting circuit 1, the oscillating circuit 2 and the voltage generating circuit 3. In addition, in response to a low level (second level) of the substrate voltage detection signal Dvsu, the output signal LAO of the latch circuit 52 is maintained at a high level.

In order to enter the data retention operation, the self retention entry signal VBRB is brought to an active level, namely, to a low level, so that the substrate leak control circuit 5 is activated. And, the power supply voltage $V_{CC}$ is changed from 3.3 V to 2.0 V. At this time, the power supply bump detecting circuit 4 detects that the power supply voltage $V_{CC}$ becomes lower than the second reference voltage $V_{r2}$ (=2.5 V in the example shown in FIG. 4). Therefore, the power supply bump detecting circuit 4 brings the power supply voltage detection signal Dbmp from the high level (first level) to a low level (second level). The second reference voltage $V_{r2}$ is preferred to be on the order of 2.6 V to 2.3 V, which is located between 3.3 V and 2.0 V. On the other hand, the substrate back bias voltage $V_{bb}$ becomes deep (namely, the absolute value becomes large) with the drop of the power supply voltage $V_{CC}$, so that the substrate voltage detection signal Dvsu is brought to a high level (first level), with the result that the oscillating circuit 2 stops its oscillation.

In response to the transition of the power supply voltage detection signal Dbmp from the high level to the low level, the one shot pulse generator 51 generates the one shot pulse Pons having a low level width (determined by the delay time of the delay element $D_{51}$), at its output terminal which has been at the high level. In response to this low level one shot pulse, the output signal LAO of the latch circuit 52 is brought to the low level, so that a negative leak control pulse LEC is generated at the output terminal of the leak control pulse generator 53, so that the transistor Q62 in the substrate leak circuit 6 is rendered conductive, thereby to form a leak path having the predetermined resistance, between the substrate and the ground potential.

As a result, a predetermined leak current $I_6$ flows between the substrate and the ground potential, so that the absolute value of the substrate back bias voltage $V_{bb}$ quickly becomes small. If the absolute value of the substrate back bias voltage $V_{bb}$ becomes small, the substrate voltage detection signal Dvsu is brought to the low level (second level), so that the oscillating circuit 2 is put in the oscillating condition. In response to the output signal of the oscillating circuit 2, the voltage generating circuit 3 supplies the substrate back bias voltage $V_{bb}$ of the predetermined level. On the other hand, in response to the low level of the substrate voltage detection signal Dvsu, the output signal LAO of the latch circuit 52 is brought to the high level, so that the leak control pulse LEC is brought to 0 V, with the result that the leak path is cut off.

At this time, the amplitude of the output of the oscillating circuit 2 is small, since the power supply voltage Vcc has becomes 0.2 V. Accordingly, the level of the substrate back bias voltage $V_{bb}$ does not reach the first reference voltage $V_{r1}$, and therefore, the substrate back bias voltage $V_{bb}$ becomes stable with its absolute value which is smaller than the absolute value of the first reference voltage $V_{r1}$.

If the power supply Voltage Vet is changed from 2.0 V to 3.3 V in order to return the operation from the data retention operation to the ordinary operation, the absolute value of the substrate back bias voltage $V_{bb}$ becomes small temporarily because of the elevation of the power supply voltage Vcc. However, since the amplitude of the output of the oscillating circuit 2 correspondingly becomes large, the absolute value of the substrate back bias voltage $V_{bb}$ increases, and finally, the substrate back bias voltage $V_{bb}$ becomes stable with its absolute value which, is substantially the same as the absolute value of the first reference voltage $V_{r1}$.

As mentioned above, the shown embodiment can reduce the consumed electric power, since the period in which the leak current flows between the substrate and the ground is only a very short time after the power supply bump is detected. In addition, since the condition in which the substrate back bias voltage $V_{bb}$ is deep (namely, the absolute value of the substrate back bias voltage $V_{bb}$ is large) terminates for only a very short time, it is possible to speed up the operation speed of the circuit.

Furthermore, when the power supply voltage Vcc is greatly lowered as compared with the ordinary operation, as in the data retention operation, the level of the substrate back bias voltage $V_{bb}$ is determined in accordance with the actual power supply voltage, and is adjusted to a proper value. In addition, even in the case that the refresh is performed in the data retention operation as in the dynamic RAM, it is possible to supply a sufficient current, so that the threshold of the transistors and the operation margin of the circuit can be maintained at proper values, and therefore, a stable circuit operation can be obtained. In other words, even if the fluctuation of the power supply voltage is large, a stable circuit operation can be obtained.

In addition, when the operation shifts to the ordinary operation, since the oscillating circuit 2 is maintained in the oscillating condition, the transit time is short, and a smooth transition can be obtained.

The invention has thus been shown and described with reference to the specific embodiments. However, it should be noted that the present invention is in no way limited to the details of the illustrated structures but changes and modifications may be made within the scope of the appended claims.

For example, the circuit construction of each of the circuits included in the semiconductor integrated circuit can be realized in various forms for performing the function of each circuit. The voltage supply bump detecting circuit 4 and the substrate leak control circuit 5 can be applied not only to the data retention operation but also to conventional voltage supply bump. In the case that no refresh operation is required in the data retention operation and a supply current to the substrate is small, it is possible to additionally provide a voltage generating circuit having a small current supply capability and to selectively use the voltage generating circuits.

I claim:

1. A semiconductor integrated circuit including a substrate back bias voltage generating circuit comprising:

a substrate back bias voltage generating means including a substrate voltage detecting circuit for comparing a first reference voltage with a substrate back bias voltage supplied to a substrate, for generating a substrate voltage detecting signal indicative of a result of the comparison, an oscillating circuit brought to either the oscillating condition or the oscillation stop condition in response to said substrate voltage detecting signal, and a voltage generating circuit responding to an output of said oscillating circuit to generate said substrate back bias voltage of a predetermined level;

a power supply voltage detecting circuit for comparing a second reference voltage with a power supply voltage and for generating a power supply voltage detecting signal which is brought to a first level or a second level in accordance with a result of the comparison;

a substrate leak control circuit generating a leak control pulse having a predetermined pulse width when said power supply voltage detecting signal changes from said first level to said second level; and a substrate leak circuit responding to said leak control pulse for connecting said substrate to a predetermined potential through a resistive means having a predetermined resistance value.

2. A semiconductor integrated circuit claimed in claim 1 wherein said predetermined potential is one of a power supply voltage and a ground potential.

3. A semiconductor integrated circuit in claim 1 wherein said power supply voltage detecting circuit generates said power supply voltage detecting signal of said first level when said power supply voltage is higher than said second reference voltage, and said power supply voltage detecting signal of said second level when said power supply voltage is not higher than said second reference voltage, wherein said substrate voltage detecting circuit generates said substrate voltage detecting signal of said first level when an absolute value of said substrate back bias voltage is larger than said first reference voltage and said substrate voltage detecting signal of said second level when said absolute value of said substrate back bias voltage is not larger than said first reference voltage;

wherein said substrate leak control circuit includes:

a one shot pulse generator of generating a one shot pulse having a predetermined pulse width in response to a change of said power supply voltage detecting signal from said first level to said second level;

a latch circuit outputting an output signal which is brought to to a first level in response to said one shot pulse and to a second level in response to said second level of said substrate voltage detecting signal; and a leak control pulse generator for generating said leak control pulse having a pulse width corresponding to a period of said first level of said output signal of said latch circuit, wherein said substrate leak circuit includes a resistive element and a transistor connected in series between said substrate and said predetermined potential, said transistor having a gate connected to receive said leak control pulse.

4. A semiconductor integrated circuit claimed in claim 1 wherein said substrate leak control circuit generates said leak control pulse during a data retention operation period.

* * * * *